United States Patent [19]

Johansson

[11] 4,232,428

[45] Nov. 11, 1980

[54] BELT BUCKLE

[76] Inventor: Lars Johansson, 631 Hicksville Rd., Far Rockaway, N.Y. 11691

[21] Appl. No.: 874,411

[22] Filed: Feb. 2, 1978

[51] Int. Cl.[3] ..... A44B 11/20

[52] U.S. Cl. ..... 24/188

[58] Field of Search ..... 24/173, 188, 210, 178, 24/180, 166, 78

[56] References Cited

U.S. PATENT DOCUMENTS

| | | | |
|---|---|---|---|
| 73,148 | 1/1868 | Wetzell | 24/166 |
| 91,390 | 6/1869 | Welker | 24/180 |
| 146,495 | 1/1874 | Walker | 24/180 |
| 795,395 | 7/1905 | Jacobson | 24/180 |
| 905,775 | 12/1908 | Warren | 24/178 |
| 1,127,727 | 2/1915 | Budge | 24/180 |
| 1,242,571 | 10/1917 | Maltby | 24/166 |
| 1,855,894 | 4/1932 | Spaulding | 24/180 |
| 2,065,946 | 12/1936 | Mader | 24/180 |
| 2,750,643 | 6/1956 | Rubin | 24/178 |
| 3,205,637 | 9/1965 | Welton | 24/180 |
| 3,965,545 | 6/1976 | Johansson | 24/186 |

FOREIGN PATENT DOCUMENTS

| | | | |
|---|---|---|---|
| 527188 | 3/1954 | Belgium | 24/188 |
| 27129 | of 1904 | United Kingdom | 24/180 |
| 749746 | 5/1956 | United Kingdom | 24/166 |

*Primary Examiner*—Ramon S. Britts

*Attorney, Agent, or Firm*—Robert L. Stone

[57] ABSTRACT

A buckle formed of a front face piece and a rear face piece. The face pieces are connected with rivets or screws at adjacent ends and adapted to be braced upon each other when open to an angle up to about 30° apart. At the end of one face piece far from the connecting rivets or screws there is an integral frictional wedged prong perpendicular to the face piece which can engage the other face piece in a positive locking manner.

12 Claims, 4 Drawing Figures

FIG. 1
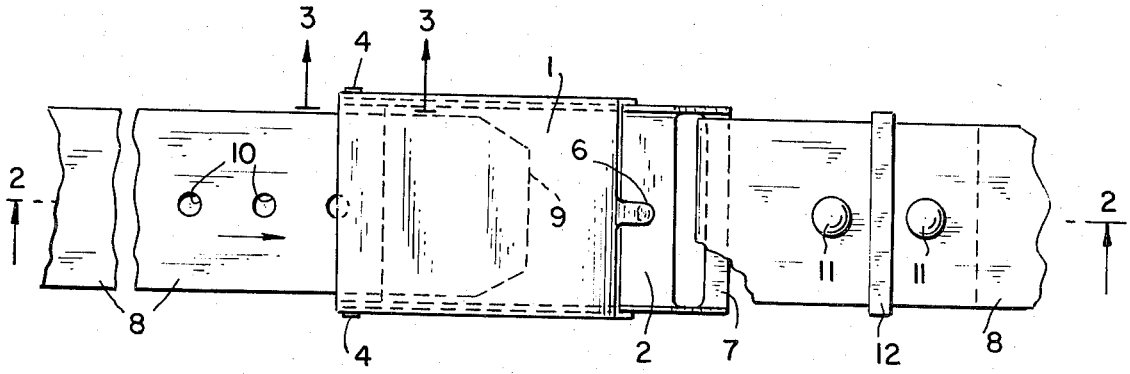
FIG. 2
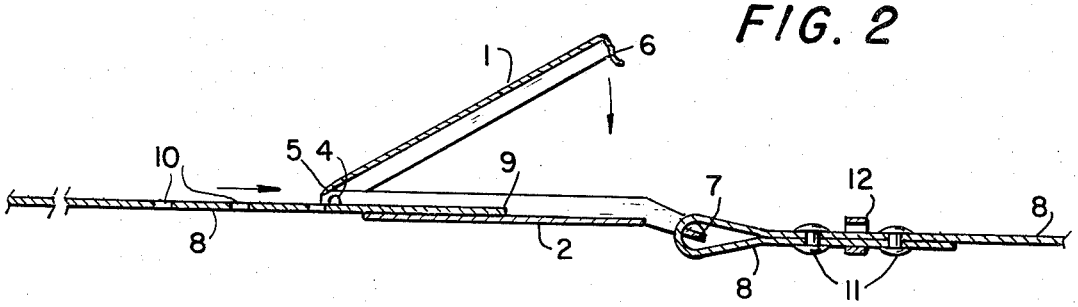
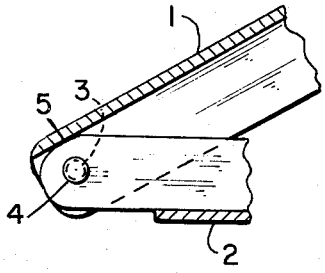
FIG. 3
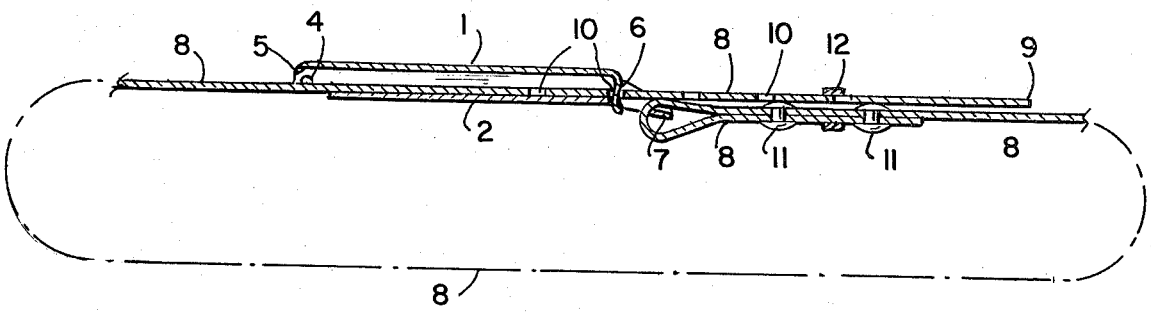
FIG. 4

BELT BUCKLE

This invention relates to a long-wearing stable substantially unbreakable buckle.

Buckles are commonly used for securing belts on pants or dresses as well as for many other purposes with straps of leather, cloth, metal etc. Buckles are often of two pieces and subject to breakage, such as at the contact point between a prong loosely attached to the main body of a buckle. In my prior U.S. Pat. No. 3,965,545, a buckle formed of a single piece of hard material was described. This buckle included a frictional prong at one end, a top and rear face and "hinges" at sides of each face at the end opposite the frictional prong. Such a buckle is strong and resistant to breakage.

The "hinge" in the buckle of my prior patent is not a true hinge and that buckle could be broken if subjected to undue and unnecessary pressure such as by being forcibly opened to angles of 90° or more. For instance, an electroplated coating could be cracked at the "hinges" by such mishandling.

It is an object of this invention to provide an improved two-piece buckle which includes a frictional prong at one end and bracing at the opposite end to stabilize the buckle against breakage. This improved buckle possesses an "equilibrium" in being stabilized by bracing when open and by the frictional prong when closed. Other objects will be apparent from consideration of the following specification.

In accordance with certain of its aspects this invention relates to a buckle formed of a front face piece and rear face piece parallel thereto when said buckle is closed, there being at the sides of adjacent ends of each face piece opening holes with connectors therein, such as rivets or screws, which connect the faces in a manner such that the two faces can open to an angle of up to about 30° apart from each other; and one said face pieces including an integral frictional wedged prong perpendicularly connected to the far end of the face piece from said holes and connectors, which prong can engage the opposite face piece in a positive locking manner.

In a desirable aspect of the invention the rear face piece has a bail extending from the end far from the holes and connectors, which extends from the rear face piece surrounding the prong when the buckle is closed. The bail is suitable for securing the buckle to a belt by looping the belt around the bail. Desirably it is bent slightly downward, for instance at the angle of about 10°-30°, preferably about 15°-30° from the remainder of the rear face piece. When the prong is on the front face piece, the downward bend of the bail assists in keeping the point of the prong away contact with the body of the wearer of the buckle.

Whether or not a bail is present, a belt can be attached adhesively or riveted to the bottom face plate and need not be looped through a bail.

The invention is illustrated in the accompanying drawings. However, it is understood that variations, modifications and alterations can be made which fall within the scope of the claims appended to this specification.

FIG. 1 is a top view of the buckle in open position, wherein the buckle carries a belt.

FIG. 2 is a side view in the direction of arrows 2—2 of FIG. 1.

FIG. 3 is a sectional side view of the section 3—3 of FIG. 1.

FIG. 4 is a side section view of the buckle in closed position wherein the buckle carries a belt.

The invention will now be further described and illustrated with more specific reference to the drawings.

FIG. 1 depicts from the top a buckle in open position when front face plate 1 is raised above rear face plate 2. Connectors 4 are present at adjacent ends of the sides of face plates 1 and 2 to hinge or join them together. The connectors are typically rivets or screws, particularly flush on the sides facing the belt, that is flush rivets or shoulder screws. An integral wedged frictional prong 6 is shown positioned perpendicularly to the front face plate 1. The buckle is shown to include a bail 7. Belt 8 is looped around bail 7. At one of its ends 9 the buckle enters between the face plates 1 and 2 near connectors 4. The belt includes locating holes 10, two snaps 11 and a keeper loop 12.

FIG. 2 depicts the buckle and belt of FIG. 1 from the side in the direction of the arrows 2—2 and FIG. 3 depicts the section 3—3 of the buckle from the side. The front face plate 1 is open above rear face plate 2 to an angle determined by the position of connectors 4 (of which one is shown in FIGS. 2 and 3) which cause the front face plate 1 to be braced against rear face plate 2 at contact point 5 (of which one is shown in FIGS. 2 and 3) which is achieved when the buckle is open to its maximum. The connectors 4 (typically flush rivets or shoulder screws) are inserted through holes 3 (of which one is shown in FIG. 3) in sides of face plates 1 and 2. The integral wedged frictional prong 6, bail 7 and belt 8 including end 9, locating holes 10, snaps 11 and keeper loop 12 of FIG. 2 as are described with reference to FIG. 1.

In FIG. 4 the buckle is in closed position and shown with a belt from the side in section. Front face plate 1 lays parallel to rear face plate 2, the two face plates being connected at connectors 4 (of which one is shown). The integral wedged frictional prong 6 engages the belt 8 through a locating hole 10 and the rear face plate 2 in a positive locking manner. The opposite end of the belt 8 is looped around bail 7, and kept in place by snaps 11. The portion of the belt 8 which has passed through the buckle is slid through keeper loop 12. The buckle of the invention does not mar or damage the belt when contacted with it. This is particularly insured by the connectors 4 being flush to the sides facing the belt so that no obstruction occurs when the belt passes between the face plates 1 and 2.

The connectors 4 serve to connect and hinge the front face piece 1 with the rear face piece 2 in such a manner that, when the pieces are open and apart, the front face piece 1 is braced against rear face piece 2 at contact point 5. The maximum angle to which opening is suitable is about 30°, typically about 5°-30°, preferably about 25°-30° and most preferably about 30°. The buckle can be of any suitable length, typically about 1-5 inches and preferably about $1\frac{1}{4}$-3 inches. The longer the buckle, the less angle is needed for the buckle to open. At opening angles greater than 30°, the strain on the buckle could cause weakening.

The integral wedged frictional prong 6 insures equilibrium against opening in the absence of snapping pressure by providing stability and tightness of the buckle in closed position. The buckle can be opened and closed many thousands of times without losing its ability to firmly engage a belt or other strap, particularly since it is difficult to mishandle and break the buckle.

In the drawings the integral prong 6 is depicted on the front face piece 1 of the buckle.

In an aspect of the invention, two or more frictional prongs may be provided on one face piece to engage the opposite face piece in a positive locking manner. This embodiment is suitable to firmly engage a belt or other strap which has a plurality of holes arranged in a straight line perpendicular to the sides of the belt or strap.

The space between the inside surfaces of the connecting rivets or screws 4 permit a belt or other strap to pass therethrough, preferably snugly. The face pieces may be square, rectangonal, pentagonal, hexagonal, round, oval etc. They are typically flat, although the front face piece may be raised above a plane, as in an arc complementary to the shape of the body over which it lies. They need not be identically shaped so long as they meet at the holes 3 where the connectors 4 are placed and adapted to open until contact is made at 5 and at the position for locking with the integral prong 6. There is preferably at least as much or more material on the front face piece than the rear normally unseen face piece. Void spaces on either or both faces can lighten the buckle and reduce the amount of material required. Perforations or voids on the front face position permit viewing of parts of the belt in the buckle area.

Attractive designs, shapes or pictures can be etched on the front face piece or coated thereon by adhesive.

The buckle is typically formed on hard material such as steel, particularly cold rolled steel and stainless steel. Steel such as cold rolled steel is especially desirable for the rear face piece. Other materials, especially for the front face piece, may be used. Such other materials include hard non-ferrous metal, particularly alloys such as nickel-silver, bronze, brass, silver and copper alloys and hard plastics such as Lucite and polyesters which are also suitable. Since the face pieces are braced against breakage by mishandling, somewhat softer materials could be used too.

The buckle can be coated. For instance brass, steel and other metals can be esthetically painted, lacquered or electroplated with gold, silver, rhodium, chromium, nickel etc. In use, the buckle is substantially stable against breakage of such coating.

The face plates 1 and 2 are typically given their shapes by stamping from a die when formed from metal, such as steel. The prong is bent mechanically and wedged into position and the bail is also mechanically bent downward. The connectors 4, such as flush rivets or shoulder screws, are inserted and placed in the holes 3 by routine mechanical procedures. Sharp edges and ridges are removed in a tumbler or vibrator. The pieces can be polished if necessary and then painted, lacquered or electroplated.

When the pieces are formed of resin they are typically made by injection molding.

Although the usefulness of the buckle has been emphasized with regard to belts, such as pants' belts, it is understood that the buckle can engage other straps such as those used to support musical string instruments (e.g., guitars) and cameras as well as luggage straps, animal collars, hanging straps, etc. The two piece buckle is especially desirable when the buckle is small in size.

Variations alternations and modifications of the buckle described above can be made without departing from the scope of the claims. The above discussion is intended to be illustrative and not limiting.

I claim:

1. A belt buckle formed of a front face piece and rear face piece parallel thereto when said buckle is closed, each of said face pieces being a single piece, said front face piece and rear face piece being the only face pieces present in said belt buckle, each face piece having opposed depending sides extending at substantially right angles thereto, and said rear face piece further having means for bracing said front face piece in the open position, there being at each of the sides of adjacent ends of each face piece opening holes with connectors therein which connectors are flush on the insides which face a belt and which connect the faces in a manner such at the two faces can open to a maximum angle of about 30° apart from each other, at which 30° angle the front face piece is braced by contact with said means on the rear face piece, each of said face pieces extending rearwardly substantially no further than the ends of their sides; and said front face piece includes an integral frictional wedged prong perpendicularly connected to the far end of said front face piece forwardly from said holes and said connectors, which prong can engage said rear face piece in a positive locking manner when the buckle is closed.

2. The buckle claimed in claim 1 wherein said connectors are flush rivets.

3. The buckle claimed in claim 1 wherein said connectors are shoulder screws.

4. The buckle claimed in claim 1 wherein said rear face piece has a bail extending from the end far from the holes and connectors which extends downwardly at an angle of about 10°–30° from the rear face piece and surrounds the prong when the buckle is closed.

5. The buckle claimed in claim 1 wherein said connectors permit said face pieces to open to an angle of about 5°–30°.

6. The buckle claimed in claim 2 wherein said flush rivets permit said face pieces to open to an angle of about 25°–30°.

7. The buckle claimed in claim 1 wherein said buckle is formed of hard metal.

8. The buckle claimed in claim 7 wherein said hard metal is selected from the group consisting of brass and steel.

9. the buckle claimed in claim 7 wherein said hard metal is electroplated.

10. The buckle claimed in claim 9 wherein said connectors are flush rivets.

11. The buckle claimed in claim 9 wherein said hard metal is electroplated with gold, silver, rhodium, chromium or nickel.

12. The buckle claimed in claim 1 wherein the top of said front face piece extends to and ends at the ends of its sides.

* * * * *